United States Patent [19]

Knop et al.

[11] Patent Number: 5,074,243

[45] Date of Patent: Dec. 24, 1991

[54] METHOD AND DEVICE FOR COATING WEBS OF MATERIAL, ESPECIALLY WEBS OF PAPER OR CARDBOARD

[75] Inventors: Reinhard Knop, Bochum; Georg Müller, Neuss; Herbert Sommer, Dusseldorf, all of Fed. Rep. of Germany

[73] Assignee: Jagenberg Aktiengesellschaft, Dusseldorf, Fed. Rep. of Germany

[21] Appl. No.: 484,021

[22] Filed: Feb. 23, 1990

[30] Foreign Application Priority Data

Mar. 15, 1989 [DE] Fed. Rep. of Germany ..... 3908386

[51] Int. Cl.[5] ..... B05C 11/04

[52] U.S. Cl. ..... 118/665; 15/256.51; 118/101; 118/122; 118/126; 118/261

[58] Field of Search ..... 118/101, 122, 123, 126, 118/261, 413, 419, 665; 15/256.5

[56] References Cited

U.S. PATENT DOCUMENTS 3,134,126 5/1964 Phillips ..... 118/101
3,221,357 12/1965 Keyworth, Jr. ..... 15/256.51
3,785,340 1/1974 Stafford et al. ..... 118/101
4,957,770 9/1990 Howarth ..... 118/665 X

FOREIGN PATENT DOCUMENTS 2825907 7/1984 Fed. Rep. of Germany .

*Primary Examiner*—Michael Wityshyn
*Attorney, Agent, or Firm*—Sprung Horn Kramer & Woods

[57] ABSTRACT

A method and device for coating a web (2) of material, especially a web of paper or cardboard, traveling over a backing roll (1) wherein coating is applied to the web is excess and reduced by a flow-control component (3), especially a doctor, to the desired thickness and wherein the flow-control component is secured to a beam (5) that extends over the operating width. The coating-thickness deviation from a straight line is determined over the operating width and employed as a parameter for controlling the heat emitted by a heater (16), especially heating strips, positioned on the side of the doctor beam facing away from the backing roller.

3 Claims, 3 Drawing Sheets

Figure 1:
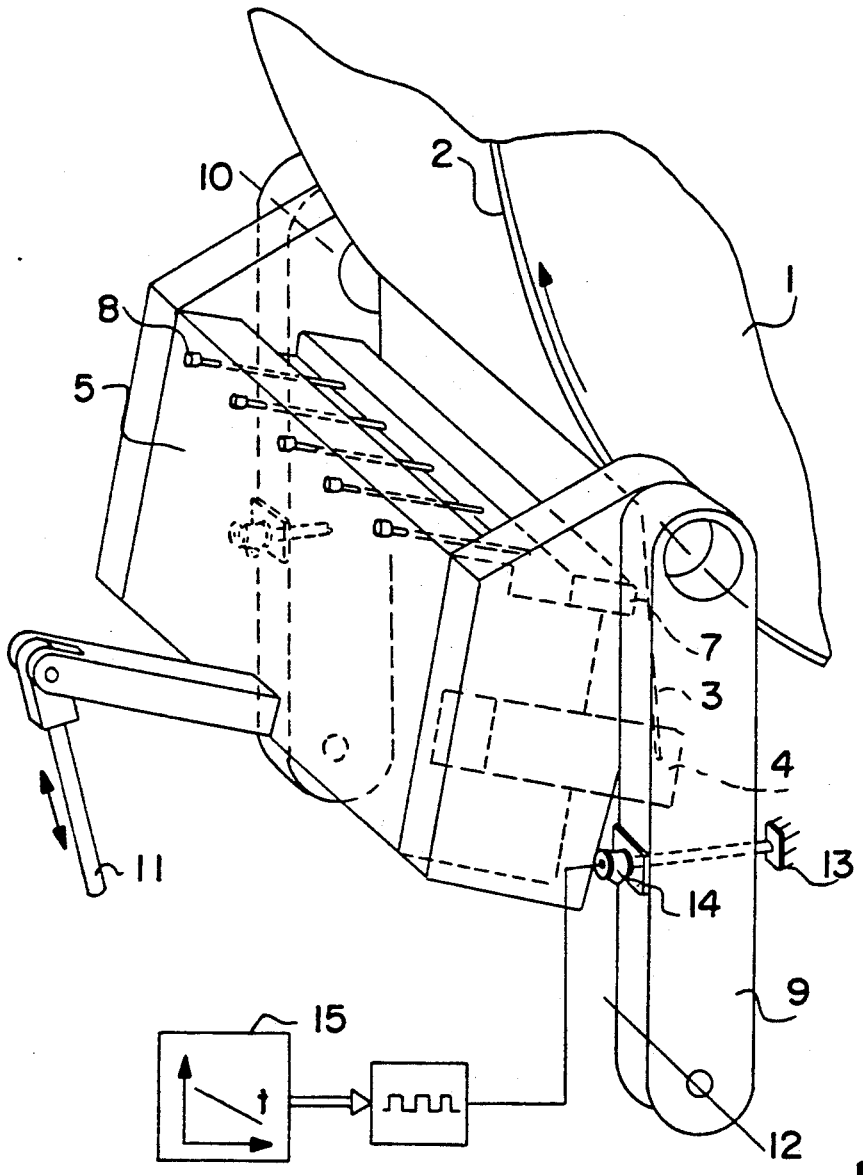

METHOD AND DEVICE FOR COATING WEBS OF MATERIAL, ESPECIALLY WEBS OF PAPER OR CARDBOARD

The invention concerns, first, a method of and continuously coating a web of material, especially a web of paper or cardboard, traveling over a backing roll.

In the known method of coating webs of material, an applicator (roller or nozzle) applies excess coating to the web and a flow-control system reduces the coating to the desired thickness. German Patent No. 2 825 907 describes the generic method and the generic device. The flow-control system is a doctor with its base secured in a pivoting beam. The coating thickness varies in accordance with how hard the knife rests against the backing roll, which is dictated in turn by the tension on the doctor.

When webs of paper or cardboard are coated, their transverse contours exhibit production-dictated fluctuations that necessitate locally varying the pressure of the doctor over the operating width in order to obtain a uniform coating. This can be done as described in the aforementioned German patent by varying the adjustment of the strip that the doctor is mounted on along the line of support in accordance with whether the coating is too thick or too thin at each point by means of tension and compression screws. This approach makes it possible to compensate for even geometric errors in tensioning or supporting the doctor that lead to changes in its shape and hence in the thickness of the coating. The known methods and devices, however, cannot compensate for variable errors in the distribution of the coating thickness that mainly derive from changes in temperature in the vicinity of the flow-control system. Unilateral heating will especially distort a doctor beam made out of a poorly heat-conducting high-grade steel, leading to irregular coating. A beam can be heated at only one end for example by warm coating and/or warm paper or even by temperature differences in the environment, due to a nearby dryer for example.

One object of the invention is to provide a generic method that can be employed to simply establish a uniform distribution of coating over the operating width a web of material such as paper or cardboard, traveling over a backing roll (1). The coating to the web if in excess, is reduced by a flowcontrol control component (3) to the desired thickness, the flow-control component being secured to a beam that extends over the operating width. In accordance with the invention, one determines the coating-thickness deviation from a straight line over the operating width and, in response thereto, controls the heat emitted by a heater positioned on the side of the flow-control component facing away from the backing roll.

By determining the slope of the corrected straight line at the surface of the coating and reducing such slope by adjusting one side of the flow-control component, it is possible to establish a rectilinearly controlled coating distribution over the total operating width. This provides a practical way of controlling the effect of the variable parameters on the distribution of coating without having to detect or measure the parameters themselves.

Another object is to provide a simple apparatus that will make it possible to compensate the coating distribution for detrimental parameters that vary during operations. The apparatus includes a backing roll with a flow-controlling flexible doctor with its base secured to a pivoting doctor beam, the beam having a side (5.1 5.2) facing away from the backing roll, and means for causing the web to travel over the backing roll. In accordance with the invention, there is provided a heater which extends over the operating width of the side (5.1 5.2) of the doctor beam (5) that faces away from the backing roll (1).

Thermostatically controlled heating strips are provided which are easy to install and cost-effective and occupy little space as well as being highly responsive. They also ensure a uniform temperature distribution over the operating width of the doctor beam without expensive controls.

There can also be provided a component which determines the transverse distribution of the coating along the operating width, and controls which employ deviations of that distribution from a straight line as input parameters and the heat emitted by the heating strips as on output parameter for keeping the surface of the coating straight.

In a preferred embodiment there is provided adjustment means on each side for independently establishing the distance of the flow-control component (3) from the backing roll (1), and means for adjusting one end of the flow-control component, thereby to minimize the slope of the straight line on the surface of the coating.

The invention will now be described with reference drawings, wherein

Figure 2:
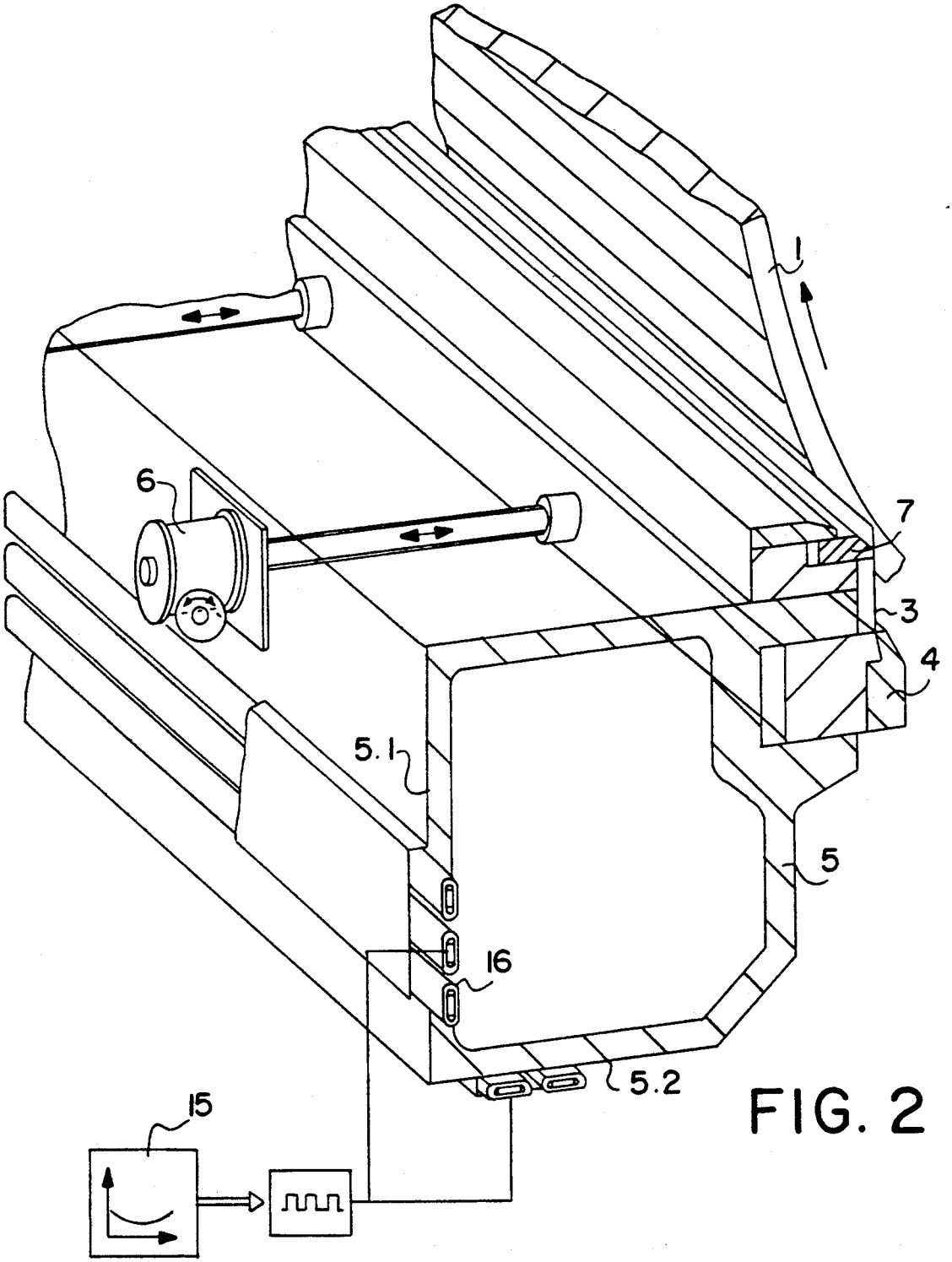
Figure 3A:
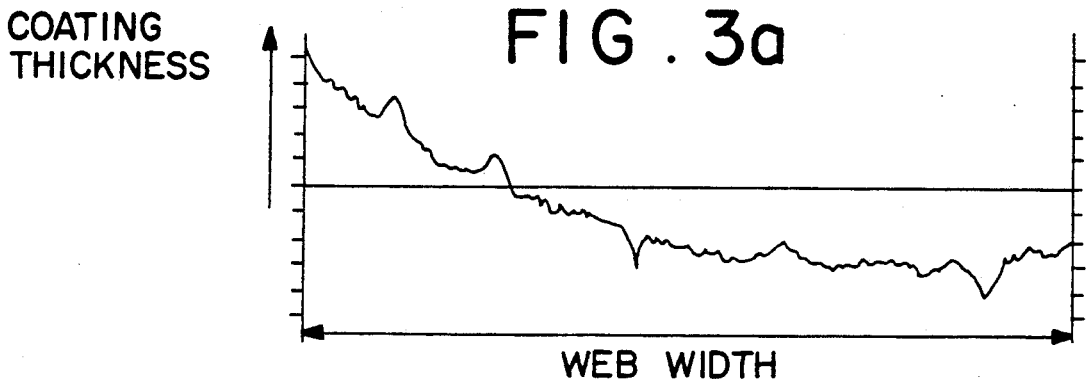
Figure 3B:
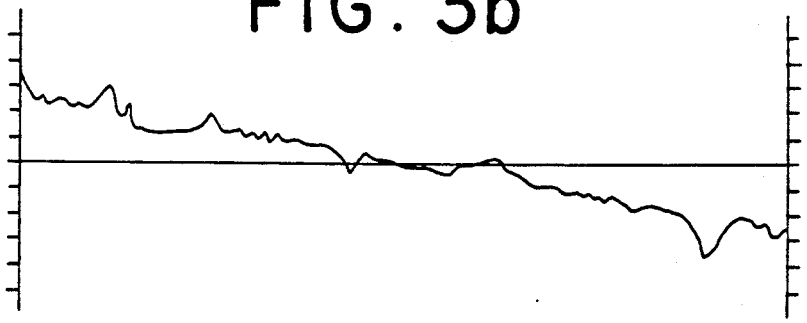
Figure 3C:
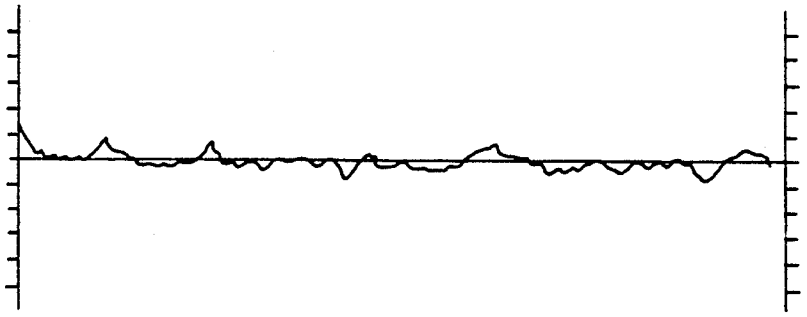

FIG. 1 is a schematic perspective view of a coater in accordance with the invention, FIG. 2 is a perspective view of a detail of FIG. 1, and FIGS. 3 *a–c* are graphs of the coating thickness, wherein FIG. 3 *a* illustrates an uncorrected distribution, FIG. 3 *b* a rectilinearly compensated distribution, and FIG. 3 *c* a distribution that has in addition had its slope decreased to a minimum.

The coater in accordance with the invention illustrated in the drawings is employed to coat a web 2 of material, paper in particular, that travels around a backing roll 1 in the direction indicated by the arrow. The coating is applied to the web in excess by an unillustrated applicator and reduced to the desired thickness by the flow-control system that will now be described.

The actual flow-control mechanism is a doctor 3 with its edge resting against web 2 and its base in a tensioning beam 4. The position of tensioning beam 4 in a doctor beam 5 can be adjusted with a spindled motor 6. Tensioning beam 4 is secured at an angle of approximately 70° to 80° in relation to doctor 3. A supporting strip 7 is secured to the side of doctor beam 5 that faces toward backing roll 1 above where doctor 3 is tensioned in. The transverse contour of supporting strip 7 can be established by way of setscrews 8 regularly distributed along the operating width.

Doctor beam 5 is suspended in a lateral frame 9 and rotates subject to a spindle-driven lifting mechanism 11 around the line (flow-control line 10) where the edge of the doctor contacts backing roll 1 with the object of establishing a particular beam angle (the angle between the tangent to backing roll 1 and the undeformed doctor). Frame 9 can be pivoted along with doctor beam 5 away from backing roll 1 around an axis 12 for cleaning or for replacing the doctor. Two lateral independently adjustable stops 13 precisely demarcate how far doctor beam 5 can pivot in against backing roll 1. The position of stops 13 themselves is established by spindle-driven lifting mechanisms 14 activated by controls 5.

Doctor beam 5 is rectangular in cross-section, and heating strips 16 are secured along the total operating width to its rear wall 5.1 and lower wall 5.2. The strips are supplied with current from an unillustrated source. The output of heating strips 16 is varied by controls 15 in accordance with the transverse contour of the coating. A particular advantage is that the heating strips in the vicinity of the edge of doctor beam 5 that faces doctor 3 are thermostatically controlled locally in accordance with the local temperature. These strips can accordingly establish the same temperature at each side 5.1 and 5.2 of doctor beam without additional controls. Thermostatically controlled strips are known and are distributed by Raychem for example under the name Auto-Trace. They are described in that firm's catalog of the same name.

The heating strips 16 in the simplest embodiment of the invention are connected to a uniform source of current in order to ensure a uniform temperature over sides 5.1 and 5.2 of doctor beam 5. The amount of current supplied to the strips depends on a prescribed difference between the temperatures of doctor 3 and of sides 5.1 and 5.2. This difference is measured by temperature sensors on the side of tensioning beam 4 that faces backing roll 1 and on beam sides 5.1 and 5.2.

The amount of current supplied to heating strips 16 and hence their output depend in an advanced and preferred embodiment on the transverse contour of the coating. The actual local thicknesses of the coating are measured at regular intervals along the operating width and their deviation from a straight line determined at prescribed sections by for example integrating the corresponding local results over the individual sections. The transverse contour of the coating is measured with known instruments, traveling detectors that determine the coating thickness from absorbed radiation for instance.

Experience indicates that the envelopes of the local curves of coating thickness often exhibit what are called tub or bombé shapes, meaning that the curves belly in negative out positively at the center of the coater (FIG. 3 *a*). The controls will accordingly govern the output of heating strips 16 to minimize the deviation of the envelope from a straight line (FIG. 3 *b*). This is possible because doctor beam 5 flexes in accordance with the difference in temperature between its side facing backing roll 1 and its sides 5.1 and 5.2 that face away from the roll. Heating sides 5.1 and 5.2 will accordingly flex the ends of the sides relative to the middle of tensioning beam 4 and accordingly vary the pressure of the edge of the doctor against web 2 and the doctor's geometry in the corresponding areas, accordingly determining the thickness of the coating. The method of control in accordance with the invention accordingly makes it possible to establish a straight contour over the operating width without involved measurements of the individual causes of deviation.

In still a further development of the invention, motorized adjustment of the distance of the doctor beam 5 from both sides of the coater is initiated in supplement to controls 15. Independently controlled lifting mechanisms 14 are accordingly positioned at each side of the coater, making it possible to tilt doctor beam 5 along the operating width by varying stops 13 within a specific range. In this embodiment of the invention, once the envelope is straightened out by heating strips 16, the slope of the straight line is determined by the controls to determine whether the coating becomes thicker along the operating width. Lifting mechanisms 14 then adjust stops 13 relative to each other in accordance with the slope of the line until the slope is zero at the desired thickness (FIG. 3 *c*).

Although the flow-control mechanisms described herein are doctors, such other flow-control mechanisms as rollers or strip secured in a doctor beam could also be employed.

It is understood that the specification and examples are illustrative but not limitative of the present invention and that other embodiments within the spirit and scope of the invention will suggest themselves to those skilled in the art.

We claim:

1. In an apparatus for coating a web of material such as paper or cardboard, including a backing roll with a flow-controlling flexible doctor with its base secured to a pivoting doctor beam, the beam having a side facing away from the backing roll, and means for causing the web to travel over the backing roll, the improvement which comprises thermostatically controlled electric heating strips disposed over the operating width of the side of the doctor beam that faces away from the backing roll, thereby to create a prescribed temperature difference in the doctor beam between the sides facing toward and away from the backing roll.

2. An apparatus according to claim 1, including means for controlling the transverse distribution of the coating along the width of said material web, said means for controlling employing deviations of the distribution from a straight line as input parameters and the heat emitted by the heating strips as an output parameter for keeping the surface of the coating straight.

3. An apparatus according to claim 2, including adjustment means at each end of the doctor beam for independently establishing the distance of the doctor from the backing roll, thereby to minimize a variation in the thickness of the coating from one side of the material web to the other.

* * * * *